US009982923B2

(12) United States Patent
Mirtchev et al.

(10) Patent No.: US 9,982,923 B2
(45) Date of Patent: May 29, 2018

(54) CONDENSATE REMOVAL TOWER

(71) Applicant: Hill Phoenix, Inc., Conyers, GA (US)

(72) Inventors: Trifon V. Mirtchev, South Chesterfield, VA (US); Zhiming Chen, Duluth, GA (US); Jamie A. Gerald, Petersburg, VA (US); Jules G. Choueifati, Richmond, VA (US)

(73) Assignee: Hill Phoenix, Inc., Conyers, GA (US)

( * ) Notice: Subject to any disclaimer, the term of this patent is extended or adjusted under 35 U.S.C. 154(b) by 215 days.

(21) Appl. No.: 14/938,305

(22) Filed: Nov. 11, 2015

(65) Prior Publication Data

US 2016/0138850 A1 May 19, 2016

Related U.S. Application Data

(60) Provisional application No. 62/081,852, filed on Nov. 19, 2014.

(51) Int. Cl.
*A47F 3/04* (2006.01)
*F25B 39/04* (2006.01)

(52) U.S. Cl.
CPC ..... *F25B 39/04* (2013.01); *F25B 2339/041* (2013.01)

(58) Field of Classification Search
CPC ..... F24F 5/0017; Y02E 60/147
USPC ..... 62/426, 247, 255, 257
See application file for complete search history.

(56) References Cited

U.S. PATENT DOCUMENTS

| | | | |
|---|---|---|---|
| 2,296,997 | A | 9/1942 | Knoy |
| 2,343,246 | A | 3/1944 | Schechter et al. |
| 2,555,968 | A | 6/1951 | Harbison |
| 3,280,580 | A | 10/1966 | Costantini et al. |
| 3,696,632 | A | 10/1972 | Carlin et al. |
| 4,766,737 | A | 8/1988 | Baxter, II |
| 5,570,587 | A | 11/1996 | Kim |
| 5,694,785 | A | 12/1997 | Balentine |
| 6,167,716 | B1 | 1/2001 | Fredrick |
| 6,360,548 | B1 | 3/2002 | Navarro |
| 6,363,736 | B1 | 4/2002 | Kunkel et al. |
| 6,895,770 | B1 | 5/2005 | Kaminski |
| 6,997,008 | B2 | 2/2006 | Lee et al. |
| 7,032,406 | B2 | 4/2006 | Hollen et al. |
| 7,278,274 | B2 | 10/2007 | Kim |
| 7,418,827 | B2 | 9/2008 | Rios |
| 2001/0017469 | A1 | 8/2001 | Sausner et al. |
| 2002/0000093 | A1 | 1/2002 | Lea |

(Continued)

*Primary Examiner* — Melvin Jones
(74) *Attorney, Agent, or Firm* — Foley & Lardner LLP

(57) ABSTRACT

An evaporative condensate dissipation system is configured to receive a liquid condensate from an external surface of a cooling element of a refrigeration system and to dissipate the liquid condensate by evaporation. The evaporative condensate dissipation system includes one or more walls constructed from a porous material configured to absorb the liquid condensate and to retain the liquid condensate within the porous material. The evaporative condensate dissipation system further includes a fan configured to generate an airflow and positioned to cause the airflow to pass through the one or more walls. The one or more walls are sufficiently permeable to allow the airflow to pass therethrough. The airflow evaporates the liquid condensate retained within the porous material of the one or more walls.

22 Claims, 7 Drawing Sheets

(56) References Cited

U.S. PATENT DOCUMENTS

| | | | | |
|---|---|---|---|---|
| 2006/0141331 | A1* | 6/2006 | Reiser | H01M 8/0258 429/414 |
| 2007/0000273 | A1 | 1/2007 | Sanders | |
| 2008/0256974 | A1 | 10/2008 | Verma et al. | |
| 2009/0035616 | A1* | 2/2009 | Darling | H01M 8/0258 429/429 |
| 2010/0083675 | A1 | 4/2010 | Merritt | |
| 2011/0042047 | A1 | 2/2011 | Karl et al. | |
| 2013/0098091 | A1 | 4/2013 | Stephens et al. | |

* cited by examiner

CONDENSATE REMOVAL TOWER

CROSS-REFERENCE TO RELATED APPLICATION

This application claims the benefit of priority to U.S. Provisional Patent Application No. 62/081,852, which was filed on Nov. 19, 2014, the complete disclosure of which is incorporated by reference herein.

BACKGROUND

The present invention relates generally to the field of temperature-controlled display devices (e.g. refrigerated display devices or cases, etc.) having a temperature-controlled space for storing and displaying products such as refrigerated foods or other perishable objects. More specifically, the present invention relates to a refrigerated display case having an evaporative condensate dissipation system for vaporizing liquid condensate (e.g., melted frost or ice from a cooling coil).

It is well known to provide a temperature-controlled display device (e.g., a refrigerator, freezer, refrigerated merchandiser, refrigerated display case, etc.) that may be used in commercial, institutional, and residential applications for storing or displaying refrigerated or frozen objects. For example, it is known to provide service type refrigerated display cases for displaying fresh food products (e.g., beef, pork, poultry, fish, etc.) in a supermarket or other commercial setting.

Refrigerated cases typically include cooling elements (e.g. cooling coils, heat exchangers, evaporators, etc.) that receive a coolant (e.g. a liquid such as a glycol-water mixture, a refrigerant, etc.) from a cooling system (e.g., a refrigeration system) during a cooling mode or operation to provide cooling to the temperature-controlled space. In some instances, the cooling system operates to provide coolant to the cooling element at a temperature below 32° F., thereby causing moisture from the air in the ambient environment to condense on the cooling element, and resulting in an accumulation of frost and/or ice on an exterior surface of the cooling element. The frost and/or ice can be removed (e.g. melted) from the cooling element during a defrost mode or operation. In other instances, the cooling system is operated at a temperature above 32° F. but below the ambient temperature, thereby causing moisture from the warmer ambient air to condense on the cooling element and run into a drain without requiring a defrost operation.

The melted frost, ice, or liquid (e.g. liquid condensate, water, etc.) from the cooling coil is usually routed to a suitable drain at or near the case's location. However, for implementations in which a drain is not conveniently accessible at the location of the refrigerated case, it may be necessary to allow the liquid condensate to accumulate in a suitable repository or receptacle. The repository may be configured for removal to permit manually disposing the liquid condensate (e.g. by pouring down a remote drain, etc.), or the repository may be configured to simply contain the liquid condensate until it dissipates by evaporation.

Previous evaporative dissipation systems have a number of deficiencies. For example, previous systems tend to overflow or spill when the rate of liquid condensate generated from defrosting exceeds the rate at which the liquid condensate can dissipate. This situation is exacerbated as ambient humidity rises because more defrosting of the cooling element is required, but less of the condensate evaporates in the humid conditions. Some evaporative condensate dissipation systems include an electric heater configured to expedite evaporation by heating the liquid condensate in the receptacle. However, such electric heaters can consume a substantial amount of electricity (e.g., up to 40% of the entire electrical load of the refrigerated case) and increase the cost and complexity of the refrigerated case. It would be desirable to provide a refrigerated display device or case with an improved evaporative condensate dissipation system that overcomes these and other disadvantages.

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

SUMMARY

One implementation of the present disclosure is an evaporative condensate dissipation system configured to receive a liquid condensate from an external surface of a cooling element of a refrigeration system and to dissipate the liquid condensate by evaporation. The evaporative condensate dissipation system includes one or more walls constructed from a porous material configured to absorb the liquid condensate and to retain the liquid condensate within the porous material. The evaporative condensate dissipation system further includes a fan configured to generate an airflow and positioned to cause the airflow to pass through the one or more walls. The one or more walls are sufficiently permeable to allow the airflow to pass therethrough. The airflow evaporates the liquid condensate retained within the porous material of the one or more walls.

Another implementation of the present disclosure is temperature-controlled display device. The temperature controlled display device includes a temperature-controlled space configured for storing and displaying products and a refrigeration system configured to circulate a refrigerant through a cooling element to provide cooling for the temperature-controlled space. The temperature-controlled display device further includes an evaporative condensate dissipation system configured to receive a liquid condensate from an external surface of the cooling element and to dissipate the liquid condensate by evaporation. The evaporative condensate dissipation system includes one or more walls constructed from a porous material configured to absorb the liquid condensate and to retain the liquid condensate within the porous material. The evaporative condensate dissipation system further includes a fan configured to generate an airflow and positioned to cause the airflow to pass through the one or more walls. The one or more walls are sufficiently permeable to allow the airflow to pass therethrough. The airflow evaporates the liquid condensate retained within the porous material of the one or more walls.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
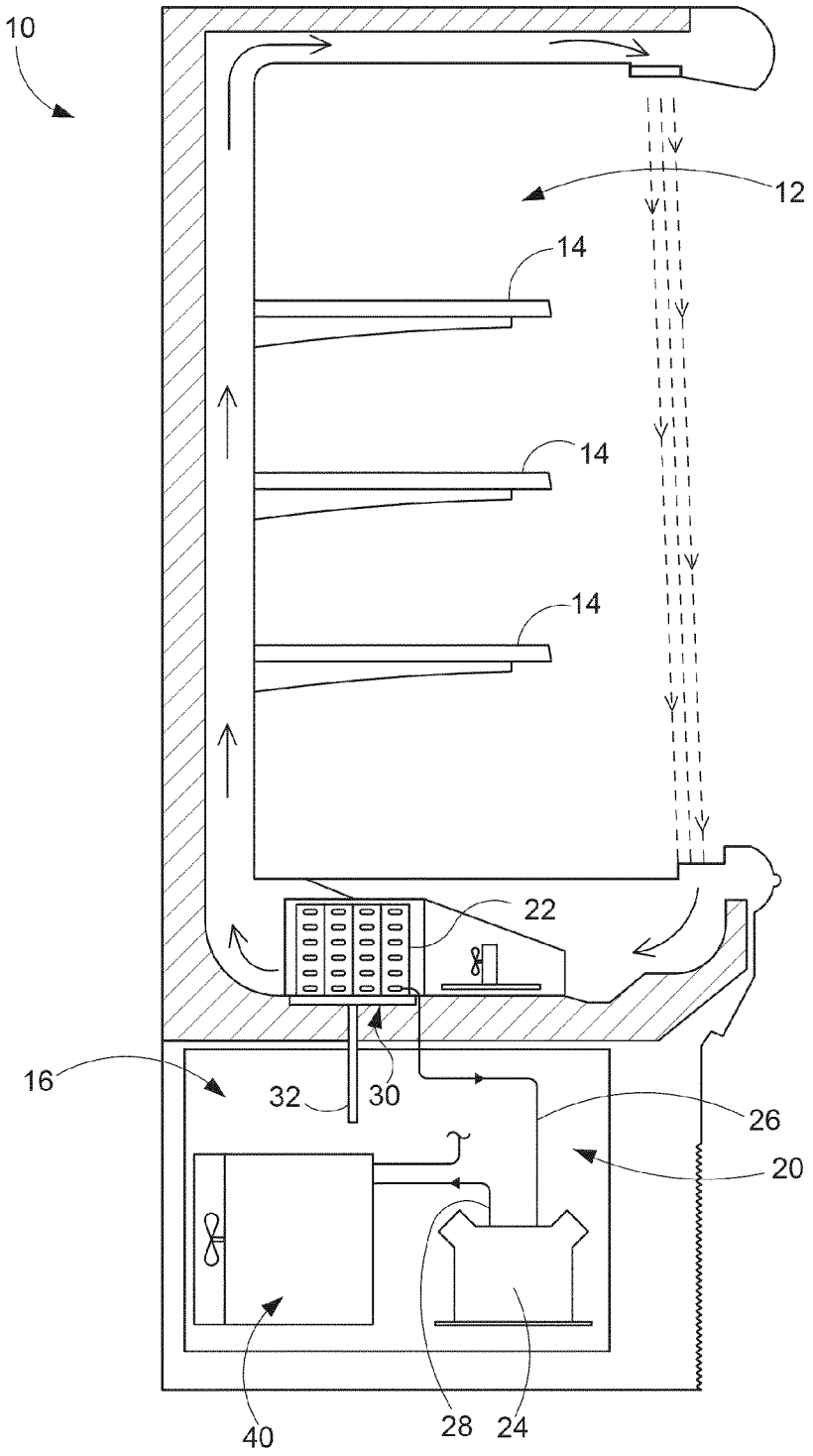
FIG. 1 is a drawing of a temperature-controlled display device equipped with a refrigeration system and condensate removal tower configured to dissipate a liquid condensate from the refrigeration system, according to an exemplary embodiment.

Referring generally to the FIGURES, a condensate removal tower and components thereof are shown, according to various exemplary embodiments. The condensate removal tower may receive a liquid condensate (e.g., from a cooling element of a refrigeration system) and dispose of the liquid condensate via evaporative dissipation. The condensate removal tower may include one or more walls constructed from a material that facilitates the evaporative dissipation of the liquid condensate. For example, the walls may be constructed from a porous material that absorbs or wicks the liquid condensate and retains a portion of the liquid condensate within the walls. The walls may be sufficiently permeable to allow an airflow to pass through the walls and evaporate the liquid condensate retained within the walls. According to other embodiments, the walls may not be permeable, and condensate evaporation may be accomplished by a splashing action and/or turbulence, over which air flows and evaporates the condensate. According to still other embodiments, the condensate may be sufficiently divided (e.g. drips, drops, etc.) with a warm plate or air flow. All such variations are intended to be within the scope of this disclosure.

The condensate removal tower may include a fan positioned to draw or push the airflow through the walls to evaporate the liquid condensate. In various embodiments, the fan may be a cooling fan for a condenser of the refrigeration system or a separate fan for the condensate removal tower. For example, the fan may be configured to generate an airflow that absorbs heat from the condenser and passes the heated airflow through the walls of the condensate removal tower. Advantageously, the heated airflow may be capable of evaporating more of the liquid condensate than could be evaporated by a relatively cooler airflow.

The condensate removal tower may include a condensate distribution system (e.g., one or more perforated distribution pans, a perforated hose, etc.) configured to distribute the liquid condensate within the walls. The condensate distribution system may be configured to receive the liquid condensate from a drain line of the refrigeration system and to deliver the liquid condensate into the walls through a plurality of evenly-spaced holes. According to other embodiments, the holes may be of any size or pattern and may be of non-uniform size or spacing, to provide advantageous evaporation characteristics for a particular application.

In some embodiments, the condensate removal tower includes a receptacle positioned below the walls. The receptacle may be configured to capture any of the liquid condensate not absorbed by the walls. In some embodiments, the liquid condensate may remain in the receptacle until it is wicked by the walls and subsequently evaporated therein. In other embodiments, the condensate removal tower includes a drain line and a pump configured to pump the liquid condensate from the receptacle back to the condensate distribution system. These and other features of the condensate removal tower are described in greater detail below.

Referring now to FIG. 1, a temperature-controlled display device 10 is shown, according to an exemplary embodiment. Temperature controlled-display device 10 may be a refrigerator, a freezer, a refrigerated merchandiser, a refrigerated display case, or other device capable of use in a commercial, institutional, or residential setting for storing and/or displaying refrigerated or frozen objects. For example, temperature-controlled display device 10 may be a service type refrigerated display case for displaying fresh food products (e.g., beef, pork, poultry, fish, etc.) in a supermarket or other commercial setting.

Temperature-controlled display device 10 is shown to include a temperature-controlled space 12 having a plurality of shelves 14 for storage and display of products therein. In various embodiments, temperature-controlled display device 10 may be an open-front refrigerated display case (as shown in FIG. 1) or a closed-front display case. An open-front display case may use a flow of chilled air that is discharged across the open front of the case to help maintain a desired temperature within temperature-controlled space 12. A closed-front display case may include one or more doors for accessing food products or other items stored within temperature-controlled space 12.

Temperature-controlled display device 10 is shown to include a refrigeration system 20 having a cooling element 22 (e.g. an evaporator, a cooling coil, a fan-coil, a heat exchanger, etc.). Cooling element 22 receives a coolant (e.g. a refrigerant, etc.) from refrigeration system 20 during a cooling mode or operation. Cooling element 22 may operate at a temperature lower than the temperature of the air within temperature-controlled space 12 to provide cooling to temperature-controlled space 12 (e.g., by absorbing heat from the air surrounding cooling element 22). As the air surrounding cooling element 22 is cooled, moisture in the air may condense on an external surface of cooling element 22 due to the cooler air having a decreased vapor pressure (e.g., a lesser ability to hold water vapor).

In some embodiments, cooling element 22 operates at a temperature lower than the freezing point of water (e.g., below 32° F.), resulting in an accumulation of frost and/or ice on an external surface of cooling element 22 during operation in the cooling mode. In some embodiments, refrigeration system 20 is configured to operate in a defrost mode. In the defrost mode, cooling element 22 may be heated to melt any accumulated frost and/or ice into a liquid condensate (e.g. water, etc.). The heat of defrosting may be provided by any suitable method such as interrupting the cooling mode and allowing ambient temperature to melt the frost/ice, using electric heating elements, or routing a hot gas refrigerant through cooling element 22.

Still referring to FIG. 1, refrigeration system 20 is shown to include a compressor 24. Compressor 24 may be configured to draw returning refrigerant from cooling element 22 through a suction line 26 and to discharge the refrigerant in a superheated hot gas state through a discharge line 28. In some embodiments, refrigeration system 20 includes one or more additional components such as a condenser (e.g., to condense the hot gas refrigerant discharged from compressor 24), an expansion device (e.g., to expand the condensed refrigerant to a low pressure, low temperature state for use by cooling element 22), a valve or other pressure-regulating device, a temperature sensor, a controller, a fan, and/or other components commonly used in refrigeration systems. Such components may be located within a compartment 16 of temperature-controlled display device 10. In some embodiments, compartment 16 is located beneath cooling element 22 and temperature-controlled space 12 (as shown in FIG. 1). In other embodiments, compartment 16 may be located behind temperature-controlled space 12, above temperature-controlled space 12, or otherwise located with respect to temperature-controlled space 12.

Still referring to FIG. 1, temperature-controlled display device 10 is shown to include a condensate removal tower 40. Condensate removal tower 40 may receive liquid condensate from an external surface of cooling element 22 and dispose of the liquid condensate via evaporative dissipation. In various embodiments, condensate removal tower 40 may receive the liquid condensate directly (e.g., by catching condensate droplets from cooling element 22) or indirectly (e.g., via drip pan 30 and drain line 32, as shown in FIG. 1). In some embodiments, condensate removal tower 40 is located in compartment 16 or otherwise integrated with temperature-controlled display device 10. In other embodiments, condensate removal tower 40 may be located external to temperature-controlled display device 10 and/or at a remote location. The liquid condensate may be delivered to condensate removal tower 40 via a gravity feed (e.g., if condensate removal tower 40 is located below cooling element 22) and/or via a fluid pump (e.g., if condensate removal tower 40 is located above cooling element 22 and/or at a remote location).

Condensate removal tower 40 may be configured to dispose of the liquid condensate without requiring access to a drain line or other traditional forms of liquid disposal (e.g., via evaporative dissipation). In some embodiments, condensate removal tower 40 is packaged as a single unit that can be readily installed (e.g. in a plug-and-play type manner) in a wide variety of temperature-controlled display devices. Advantageously, condensate removal tower 40 may be readily installed or removed from a temperature-controlled display device to adapt temperature-controlled display device 10 for use in various implementations, regardless of access to drainage.

In some embodiments, condensate removal tower 40 uses heat from compressor 24 and/or condenser of refrigeration system 20 to assist with the evaporative dissipation. In other embodiments, condensate removal tower 40 dissipates the liquid condensate without the assistance of heat from these or other components. For example, condensate removal tower 40 may be used with refrigeration or cooling systems in which the compressors and/or condensers are positioned at a different location than condensate removal tower 40 (e.g., a rooftop, a machine room, etc.).

Figure 2:
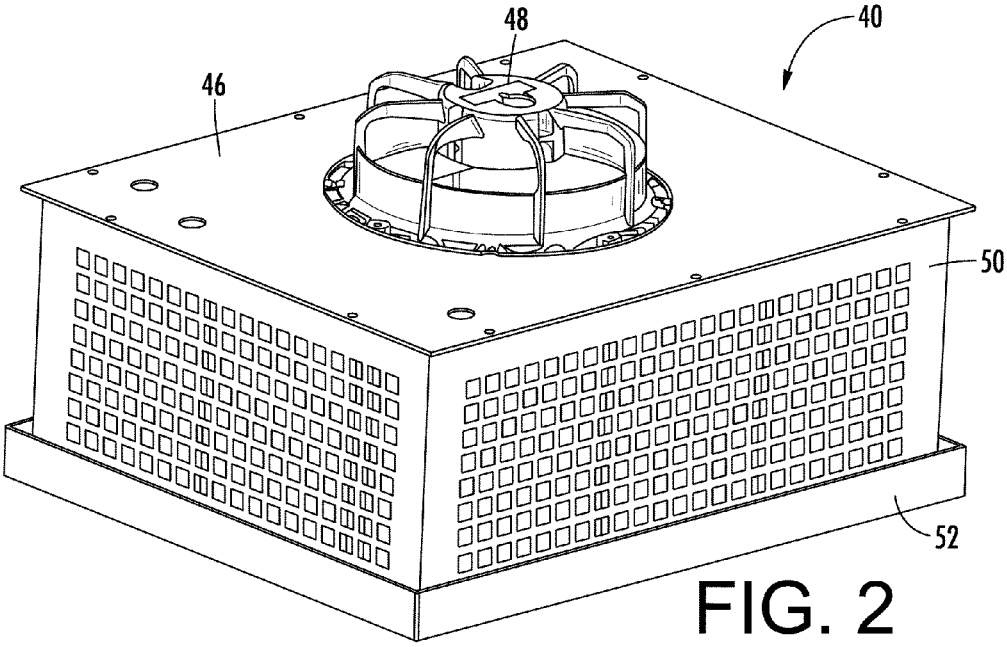
FIG. 2 is a perspective drawing illustrating the condensate removal tower of FIG. 1 in greater detail, according to an exemplary embodiment.
Figure 3:
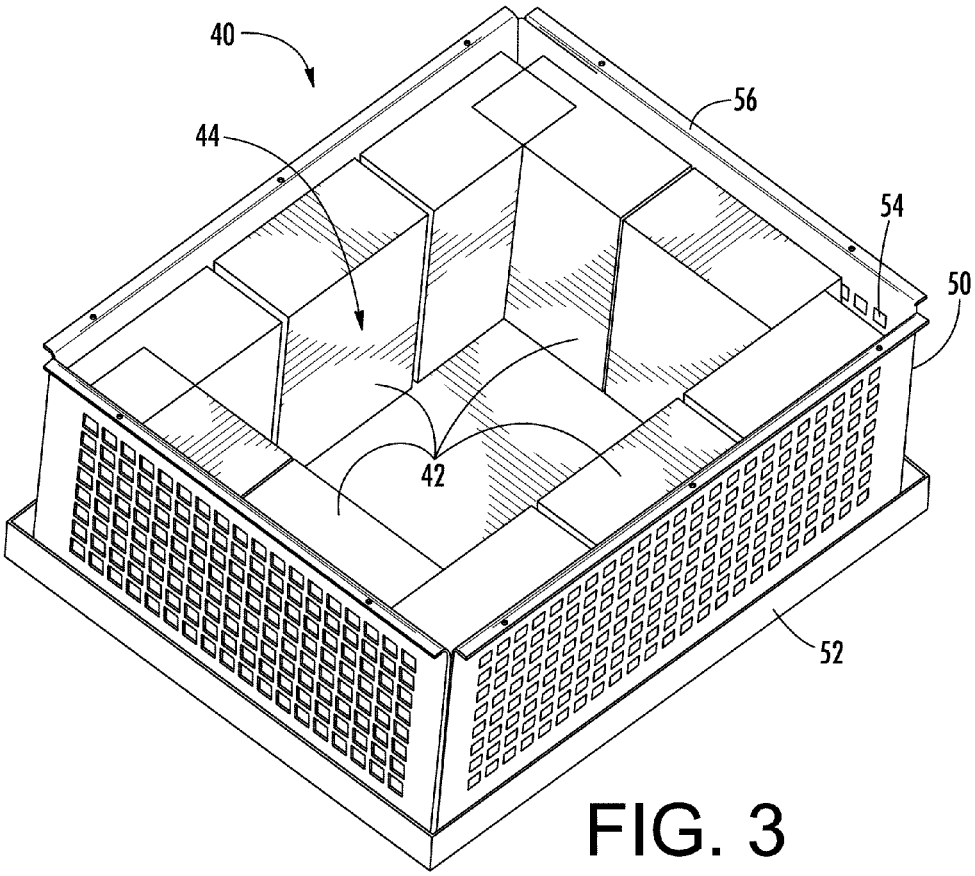
FIG. 3 is a perspective drawing of the condensate removal tower of FIG. 2 with the cover removed and showing a plurality of walls configured to absorb and retain the liquid condensate for improved evaporative dissipation, according to an exemplary embodiment.

Referring now to FIGS. 2-5, condensate removal tower 40 is shown in greater detail, according to various exemplary embodiments. Condensate removal tower 40 may be configured to receive a liquid condensate (e.g. liquid water, melted frost, melted ice, etc.) from an external surface of cooling element 22 and to dissipate the liquid condensate by evaporation. Referring particularly to FIGS. 2-3, condensate removal tower 40 is shown to include a plurality of walls 42. In some embodiments, walls 42 form a closed perimeter around a space 44 within condensate removal tower 40. In other embodiments, walls 42 may include only a single wall or a plurality of walls that do not form a closed perimeter.

Walls 42 may be constructed from a material that facilitates the evaporative dissipation of the liquid condensate. For example, walls 42 may be constructed from a porous material that absorbs or wicks the liquid condensate such that the liquid condensate is at least partially retained within each of walls 42 (e.g., within the porous material). The material from which walls 42 are constructed may also be sufficiently permeable to allow an airflow to pass through walls 42. The airflow may be caused, for example, by a fan 48 positioned to draw or push the airflow through walls 42. In various embodiments, fan 48 may be positioned within an opening in a cover 46 over space 44 (as shown in FIG. 2) or otherwise positioned to cause an airflow through walls 42. The airflow caused by fan 48 evaporates some or all of the liquid condensate retained within walls 42 and carries the evaporated condensate out of walls 42 in a vaporized form. The evaporation also reduces the saturation of the liquid condensate within walls 42 (e.g., dries walls 42), thereby allowing walls 42 to absorb more of the liquid condensate.

In some embodiments, condensate removal tower 40 is positioned upstream of an air-cooled condenser of refrigeration system 20. The evaporation caused by condensate removal tower 40 may cool the airflow passing through walls 42. The cooled airflow may then be provided to the condenser to absorb heat rejected by the refrigeration circuit. Advantageously, the cooling provided to the airflow by condensate removal tower 40 allows the airflow to absorb more heat in the condenser, thereby improving the efficiency of the refrigeration circuit.

Still referring to FIGS. 2-3, condensate removal tower 40 is shown to include a frame 50. Both frame 50 and walls 42 may be permeable to the airflow caused by fan 48. For example, frame 50 is shown to include a plurality of ventilation holes 54 that allow the airflow caused by fan 48 to pass through frame 50. Frame 50 may be configured to provide structural support for walls 42 and to protect walls 42 from external damage. Walls 42 may be attached to frame 50 to ensure that walls 42 are maintained in an operating position (e.g., as shown in FIG. 3). In some embodiments, frame 50 includes a flange 56 configured to provide a mounting surface for cover 46. Cover 46 may be secured to flange 56 (as shown in FIG. 2) to close space 44, thereby forcing the airflow caused by fan 48 through walls 42.

Figure 5:
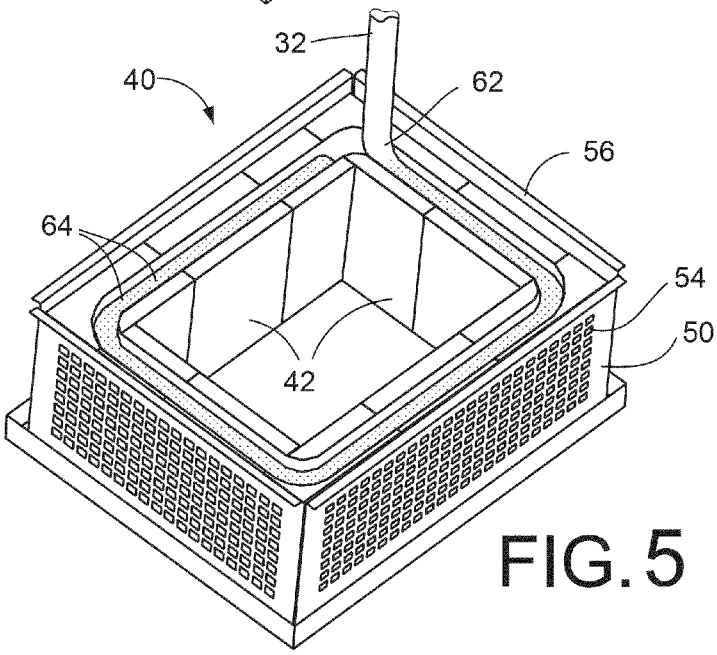
FIG. 5 is a perspective drawing of the condensate removal tower of FIG. 3 with a perforated hose configured to distribute the liquid condensate across an upper portion of the plurality of walls, according to an exemplary embodiment.

In some embodiments, condensate removal tower 40 includes a receptacle 52. Receptacle 52 may be configured to capture and/or contain any of the liquid condensate in condensate removal tower 40 not absorbed by walls 42. Walls 42 may be positioned within receptacle 52 and configured to absorb or wick the liquid condensate accumulated in receptacle 52. For example, a lower portion of walls 42 may be submerged in the liquid condensate accumulated in receptacle 52. In some embodiments, the liquid condensate from drain line 32 (as shown in FIG. 5) is distributed across an upper portion of walls 42 and any condensate that does not evaporate in walls 42 is captured by receptacle 52. In other embodiments, the liquid condensate from drain line 32 flows directly into receptacle 52 and a lower portion of walls 42 absorb the liquid condensate from receptacle 52.

Figure 4:
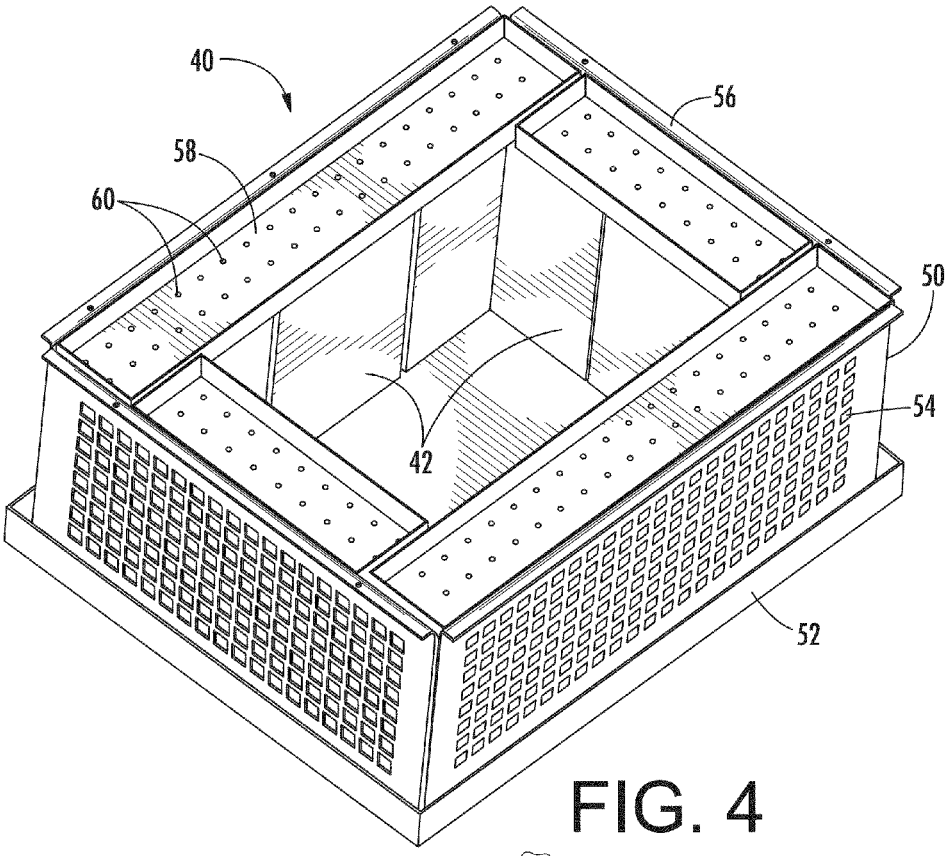
FIG. 4 is a perspective drawing of the condensate removal tower of FIG. 3 with a plurality of condensate distribution trays configured to distribute the liquid condensate across an upper portion of the plurality of walls, according to an exemplary embodiment.

Referring now to FIGS. 4-5, several components that may be used to distribute the liquid condensate across walls 42 are shown, according to an exemplary embodiment. Referring particularly to FIG. 4, condensate removal tower 40 is shown to include distribution pans 58 positioned directly above walls 42. Distribution pans 58 may include a plurality of separate distribution pans (e.g., one for each of walls 42, as shown in FIG. 4) or a single distribution pan that spans all of walls 42. Distribution pans 58 may receive the liquid condensate from drain line 32 and spread the liquid condensate across an upper portion of walls 42. In some embodiments, distribution pans 58 include a plurality of holes 60 configured to allow the liquid condensate to flow from distribution pans 58 into walls 42. Holes 60 may be spaced (e.g. evenly, or non-uniformly) along distribution pans 58 such that the liquid condensate in distribution pans 58 is distributed to walls 42 in a desirable flow pattern or profile. The liquid condensate from holes 60 may flow downward through walls 42 toward receptacle 52.

Referring particularly to FIG. 5, condensate removal tower 40 is shown to include a perforated hose 62 positioned directly above walls 42. According to other embodiments the perforated hose may be integrated into the walls. Hose 62 may be used as an alternative to distribution pans 58 to distribute (e.g. substantially evenly or otherwise) the liquid condensate to walls 42. In some embodiments, hose 62 is an extension of drain line 32. Hose 62 may receive the liquid condensate from drain line 32 and spread the liquid condensate across the upper portion of walls 42. In some embodiments, hose 62 includes a plurality of holes 64 configured to allow the liquid condensate to flow from hose 62 into walls 42. Holes 64 may be evenly spaced along hose 62 such that the liquid condensate in hose 62 is substantially evenly distributed to walls 42, or the holes may have non-uniform sizing or spacing to provide a customized flow distribution pattern. The liquid condensate from holes 64 may flow downward through walls 42 toward receptacle 52.

Figure 6:
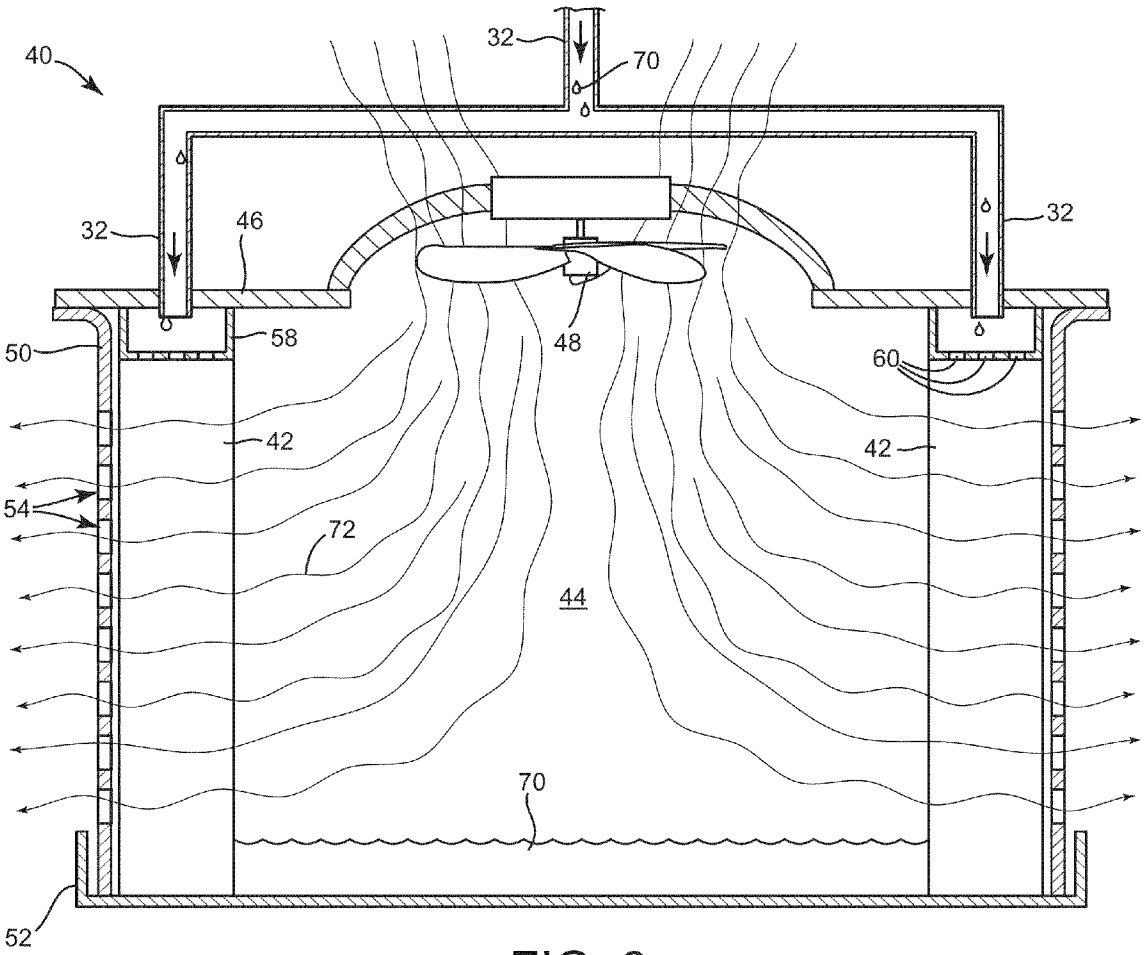
FIG. 6 is a cross-sectional drawing of the condensate removal tower of FIG. 2, according to an exemplary embodiment.
Figure 7:
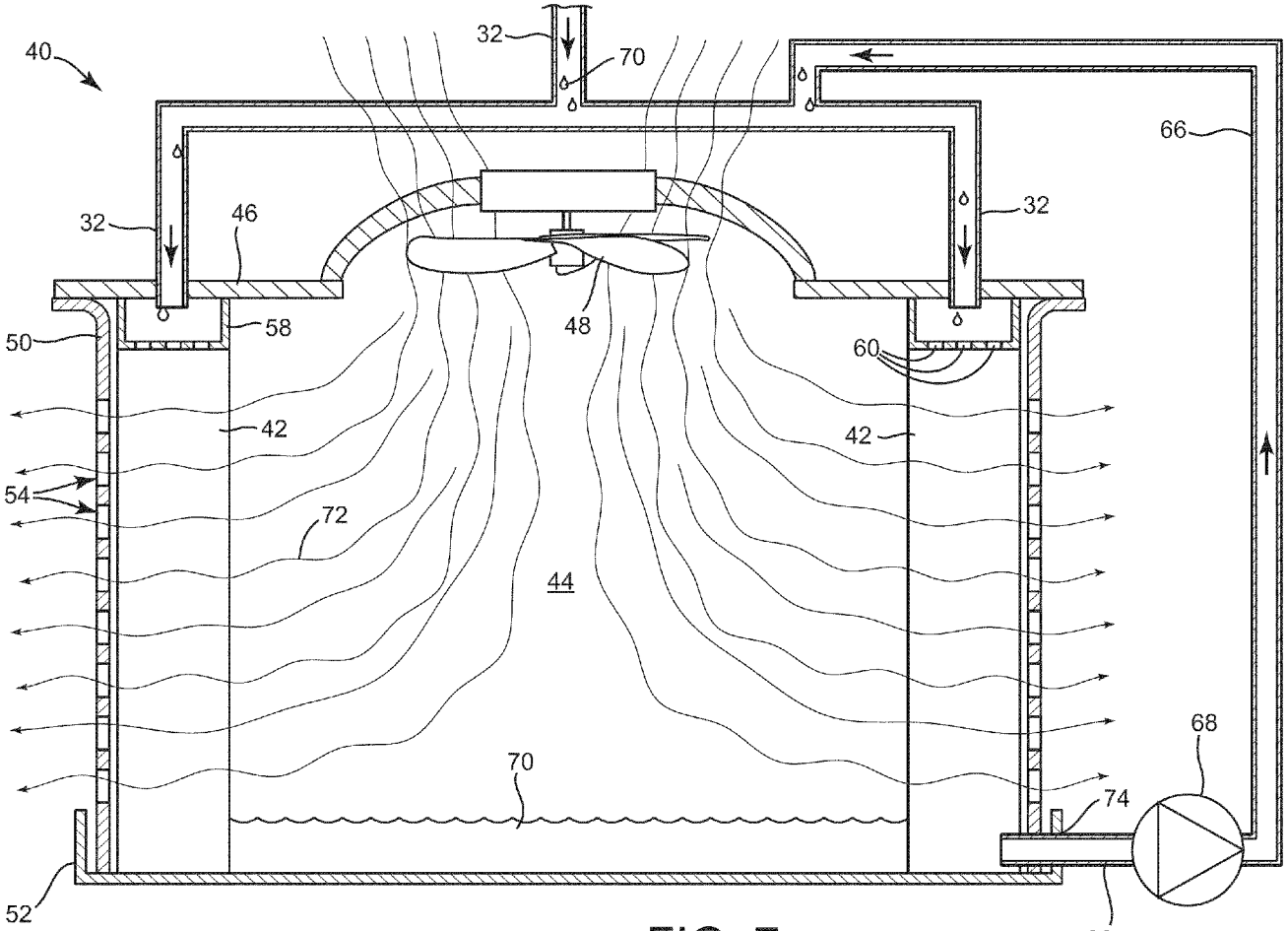
FIG. 7 is a cross-sectional drawing of the condensate removal tower of FIG. 2 with a drain line and a pump configured to pump the liquid condensate from a receptacle below the plurality of walls and to reintroduce the pumped liquid condensate to the upper portion of the plurality of walls, according to an exemplary embodiment.

Referring now to FIGS. 6-7, a cross-sectional view of condensate removal tower 40 is shown, according to an exemplary embodiment. In FIG. 6, droplets of the liquid condensate 70 are delivered to distribution pans 58 via drain line 32. The liquid condensate 70 in distribution pans 58 may flow through holes 60 and into walls 42. Walls 42 absorb the liquid condensate 70 and at least partially retain the liquid condensate within walls 42. Any liquid condensate 70 not retained within walls 42 may be captured by receptacle 52 and may accumulate in receptacle 52 as a standing liquid.

Fan 48 may be operated (e.g., by a controller) to cause an airflow 72 to pass through walls 42 and ventilation holes 54 in frame 50. In some embodiments, fan 48 directs airflow 72 downward into space 44 through the opening in cover 46 and outward from space 44 through walls 42 and ventilation holes 54 in frame 50. In other embodiments, fan 48 directs airflow 72 inward into space 44 through walls 42 and upward from space 44 through the opening in cover 46. Airflow 72 causes the liquid condensate within walls 42 to evaporate and carries the evaporated condensate out of condensate removal tower 40 along with airflow 72. The evaporation in walls 42 causes walls 42 to become relatively drier, thereby causing walls 42 to absorb or wick the liquid condensate 70 accumulated in receptacle 52.

Referring particularly to FIG. 7, condensate removal tower 40 is shown to include a drain line 66 connected to receptacle 52. In various embodiments, drain line 66 may be connected to an opening 74 in a side or bottom wall of receptacle 52 (as shown in FIG. 7) or connected to a standpipe in the bottom of receptacle 52. Drain line 66 may be configured to drain a portion of the liquid condensate 70 (i.e., the excess liquid condensate) from receptacle 52 once the amount of the liquid condensate 70 in receptacle 52 reaches the level of opening 74 (or higher). In some embodiments, drain line 66 is connected to a pump 68 configured to pump the excess liquid condensate back to drain line 32, where the excess liquid condensate is reintroduced to distribution pans 58, or perforated drain line 62, and/or walls 42. In other embodiments, pump 68 may pump the excess liquid condensate back to drip pan 30 or to a separate receptacle where the excess liquid condensate may be stored until the level of the liquid condensate 70 in receptacle 52 drops below opening 74 (or other suitable level control point).

Figure 8:
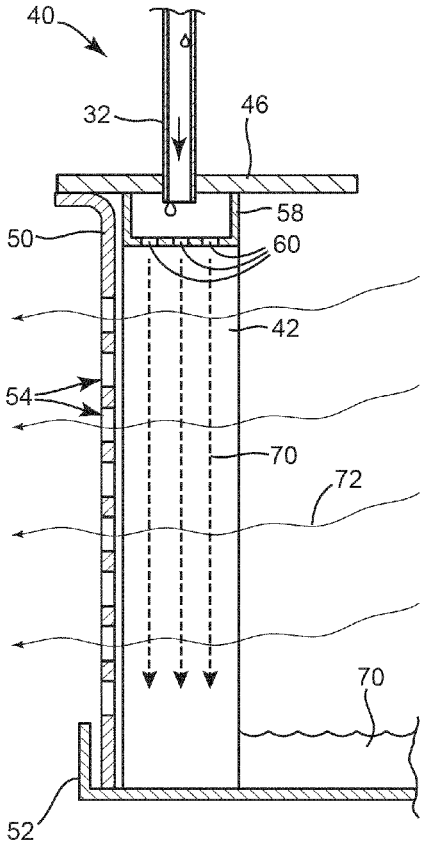
FIG. 8 is a cross-sectional drawing of a portion of the condensate removal tower of FIG. 2 illustrating the operation of the condensate removal tower during a defrost process in which the liquid condensate is received via a drain line from the refrigeration system, according to an exemplary embodiment.
Figure 9:
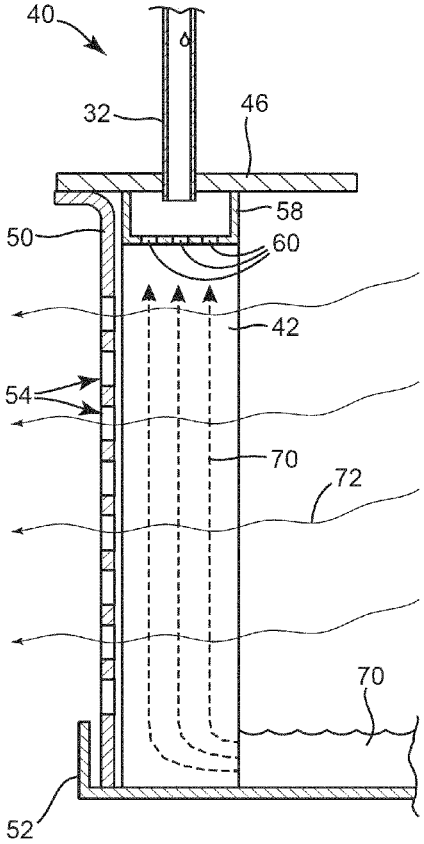
FIG. 9 is a cross-sectional drawing of a portion of the condensate removal tower of FIG. 2 illustrating the operation of the condensate removal tower when the liquid condensate is no longer received via the drain line from the refrigeration system, according to an exemplary embodiment.

Referring now to FIGS. 8-9, several cross-sections illustrating the operation of condensate removal tower 40 are shown, according to exemplary embodiments. Referring particularly to FIG. 8, condensate removal tower 40 is shown when refrigeration system 20 (see FIG. 1) is operated in a defrost mode. During the defrost mode, any frost or ice accumulated on cooling element 22 (see FIG. 1) is melted and delivered to condensate removal tower 40 as droplets of liquid condensate 70. As shown in FIG. 8, droplets of the liquid condensate 70 may be delivered to distribution pans 58 via drain line 32. The liquid condensate 70 in distribution pans 58 flows through holes 60 and into walls 42. Within walls 42, the liquid condensate 70 flows downward toward receptacle 52. Walls 42 absorb some or all of the liquid condensate 70 and at least partially retain the liquid condensate 70 within walls 42.

Airflow 72 passes through walls 42 and causes a portion of the liquid condensate 70 within walls 42 to evaporate. If the rate of evaporation is less than the rate at which the droplets of liquid condensate 70 are received from drain line 32, walls 42 may become fully saturated with the liquid condensate 70. Any liquid condensate 70 in excess of the saturation limit of walls 42 may be captured by receptacle 52 and may accumulate in receptacle 52 as a standing liquid. In some embodiments, the excess liquid condensate 70 in receptacle 52 may be pumped back to the top of walls 42 and reintroduced to distribution pans 58 or distribution hose 62 (e.g., as described with reference to FIG. 7).

Referring particularly to FIG. 9, condensate removal tower 40 is shown with drain line 32 no longer delivering droplets of the liquid condensate 70 to distribution pans 58. FIG. 9 may correspond to the state of condensate removal tower 40 once the defrost operation has finished melting the ice and/or frost from cooling element 22, or during a period between defrost cycles, after drainage is complete and while frost is re-accumulating on the coil, until just before the next defrost cycle. In FIG. 9, airflow 72 continues to evaporate the liquid condensate 70 within walls 42 and carry the evaporated condensate out of condensate removal tower 40 along with airflow 72. Since the droplets of the liquid condensate 70 are no longer being delivered to distribution pans 58, the evaporation in walls 42 may cause the saturation of the liquid condensate 70 in walls 42 to decrease below the saturation limit. The relatively drier condition of walls 42 causes walls 42 to absorb or wick the liquid condensate 70 accumulated in receptacle 52, thereby causing the liquid condensate 70 to flow upward in walls 42. Airflow 72 may continue to evaporate the liquid condensate 70 from walls 42 until all of the liquid condensate 70 has been evaporated. In some embodiments, condensate removal tower 40 includes a humidity sensor and/or a water level sensor configured to sense when the liquid condensate 70 has been fully evaporated. The water level sensor may also be used to activate or deactivate pump 68 (e.g., when the water level in receptacle 52 reaches a threshold level).

Figure 10:
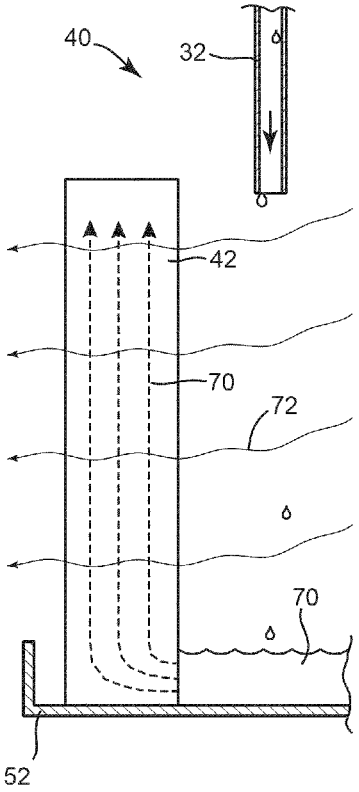
FIG. 10 is a cross-sectional drawing of a portion of the condensate removal tower of FIG. 2 illustrating the operation of the condensate removal tower when the liquid condensate is received directly in the receptacle from the drain line of the refrigeration system and wicked upward through the plurality of walls, according to an exemplary embodiment.

Referring now to FIG. 10, a cross-section illustrating the operation of condensate removal tower 40 is shown, according to another exemplary embodiment. In FIG. 10, droplets of the liquid condensate 70 are delivered from drain line 32 directly to receptacle 52 without first passing through walls 42. Receptacle 52 captures the liquid condensate 70 and accumulates the liquid condensate 70 as a standing liquid. Walls 42 absorb or wick the liquid condensate 70 accumulated in receptacle 52, thereby causing the liquid condensate 70 to flow upward in walls 42. Airflow 72 passes through walls 42 and causes a portion of the liquid condensate 70 within walls 42 to evaporate. Airflow 72 may continue to evaporate the liquid condensate 70 from walls 42 until all of the liquid condensate 70 has been evaporated.

Figure 11:
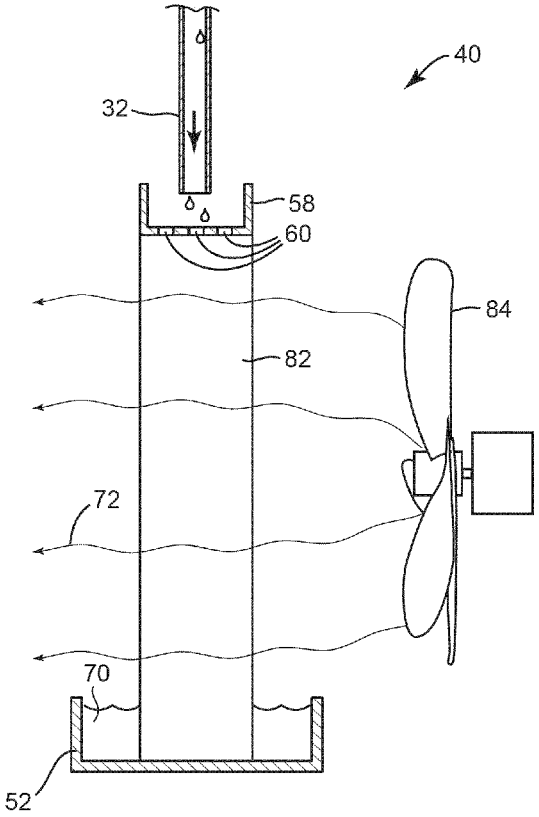
FIG. 11 is a cross-sectional drawing of another embodiment of the condensate removal tower of FIG. 1 in which the tower includes a single wall in place of the plurality of walls, according to an exemplary embodiment.

Referring now to FIG. 11, condensate removal tower 40 is shown, according to another exemplary embodiment. In FIG. 11, condensate removal tower 40 includes a single wall 82 in instead of a plurality of walls 42. Wall 82 may be the same or similar to one of walls 42, as described with reference to FIGS. 2-10. In various embodiments, condensate removal tower 40 may include any number of walls configured to absorb, wick, and/or retain the liquid condensate 70. Droplets of the liquid condensate 70 may be delivered to a distribution pan 58 positioned above wall 82 via drain line 32, or may be delivered to any other component for distribution. The liquid condensate 70 in distribution pan 58 flows through holes 60 and into wall 82. Within wall 82, the liquid condensate 70 flows downward toward receptacle 52. Wall 82 absorbs some or all of the liquid condensate 70 and at least partially retains the liquid condensate 70 within wall 82.

As shown in FIG. 11, a fan 84 may be positioned adjacent to wall 82 and configured to push or draw an airflow 72 through wall 82. In some embodiments, fan 84 is configured to provide cooling for a condenser of refrigeration system 20. For example, fan 84 may be configured to generate an airflow 72 that absorbs heat from the condenser and passes the heated airflow through wall 82. Advantageously, the heated airflow may be capable of evaporating more of the liquid condensate than could be evaporated by a relatively a cooler airflow.

Airflow 72 passes through wall 82 and causes a portion of the liquid condensate 70 within wall 82 to evaporate. If the rate of evaporation is less than the rate at which the droplets of liquid condensate 70 are received from drain line 32, wall 82 may become fully saturated with the liquid condensate 70. Any liquid condensate 70 in excess of the saturation limit of wall 82 may be captured by receptacle 52 and may accumulate in receptacle 52 as a standing liquid.

The evaporation in wall 82 may cause the saturation of the liquid condensate 70 in wall 82 to decrease below the saturation limit. The relatively drier condition of wall 82 may cause wall 82 to absorb or wick the liquid condensate 70 accumulated in receptacle 52, thereby causing the liquid condensate 70 to flow upward in wall 82. Airflow 72 may continue to evaporate the liquid condensate 70 from wall 82 until all of the liquid condensate 70 has been evaporated.

The construction and arrangement of the temperature-controlled display device, refrigeration system, and/or evaporative condensate dissipation system as shown in the various exemplary embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

What is claimed is:

1. An evaporative condensate dissipation system configured to receive a liquid condensate from an external surface of a cooling element of a refrigeration system and to dissipate the liquid condensate by evaporation, the evaporative condensate dissipation system comprising:

one or more walls constructed from a porous material configured to absorb the liquid condensate and to retain the liquid condensate within the porous material; and a fan configured to generate an airflow and positioned to cause the airflow to pass through the one or more walls;

a condensate distribution system configured to distribute the liquid condensate across the one or more walls, the condensate distribution system comprising one or more perforated dissipation pans positioned above or integrated within the one or more walls and configured to receive the liquid condensate from the refrigeration system;

wherein the one or more walls are sufficiently permeable to allow the airflow to pass therethrough and wherein the airflow evaporates the liquid condensate retained within the porous material of the one or more walls.

2. The evaporative condensate dissipation system of claim 1, wherein the condensate distribution system is configured to distribute the liquid condensate across a top portion of the one or more walls.

3. The evaporative condensate dissipation system of claim 2, wherein the one or more perforated dissipation pans are configured to receive the liquid condensate from a drain line of the refrigeration system.

4. The evaporative condensate dissipation system of claim 2, wherein the condensate distribution system comprises a perforated hose positioned above or integrated within the one or more walls and configured to receive the liquid condensate from a drain line of the refrigeration system.

5. The evaporative condensate dissipation system of claim 1, wherein the one or more walls are positioned in the airflow downstream of a heat-rejecting element of the refrigeration system;

wherein the airflow absorbs heat from the heat-rejecting element and the heated airflow passes through the one or more walls.

6. The evaporative condensate dissipation system of claim 1, wherein evaporating the liquid condensate cools the airflow and the cooled airflow is provided to a condenser of the refrigeration system to absorb heat from the condenser.

7. The evaporative condensate dissipation system of claim 1, further comprising a receptacle positioned below the one or more walls and configured to capture at least a portion of the liquid condensate not retained within the porous material of the one or more walls.

8. The evaporative condensate dissipation system of claim 7, wherein the one or more walls are at least partially submerged in the liquid condensate in the receptacle;

wherein the one or more walls are configured to wick the liquid condensate from within the receptacle and to retain the wicked liquid condensate within the porous material.

9. The evaporative condensate dissipation system of claim 7, wherein:

the liquid condensate from the refrigeration system is introduced to an upper portion of the one or more walls and flows downward through the one or more walls toward the receptacle;

the one or more walls absorb the liquid condensate introduced to the upper portion until the one or more walls become fully saturated with the liquid condensate; and the receptacle captures the liquid condensate introduced to the upper portion after the one or more walls become fully saturated with the liquid condensate.

10. The evaporative condensate dissipation system of claim 7, further comprising:

a drain line configured to receive the liquid condensate from the receptacle; and a pump disposed along the drain line and configured to pump the liquid condensate from the receptacle toward an upper portion of the one or more walls, wherein the pumped liquid condensate is reintroduced to the one or more walls at the upper portion.

11. The evaporative condensate dissipation system of claim 7, wherein:

the liquid condensate from the refrigeration system is received in the receptacle, introduced to a lower portion of the one or more walls submerged in the liquid condensate, and flows upward from the lower portion through the one or more walls;

the one or more walls absorb the liquid condensate introduced to the lower portion until the one or more walls become fully saturated with the liquid condensate; and the receptacle retains the liquid condensate introduced to the lower portion after the one or more walls become fully saturated with the liquid condensate.

12. A temperature-controlled display device comprising:

a temperature-controlled space configured for storing and displaying products;

a refrigeration system configured to circulate a refrigerant through a cooling element to provide cooling for the temperature-controlled space; and an evaporative condensate dissipation system configured to receive a liquid condensate from an external surface of the cooling element and to dissipate the liquid condensate by evaporation, the evaporative condensate dissipation system comprising:

one or more walls constructed from a porous material configured to absorb the liquid condensate and to retain the liquid condensate within the porous material; and a fan configured to generate an airflow and positioned to cause the airflow to pass through the one or more walls;

wherein the one or more walls are sufficiently permeable to allow the airflow to pass therethrough and wherein the airflow evaporates the liquid condensate retained within the porous material of the one or more walls.

13. The temperature-controlled display device of claim 12, wherein the evaporative condensate dissipation system further comprises a condensate distribution system configured to distribute the liquid condensate across a top portion of the one or more walls.

14. The temperature-controlled display device of claim 13, wherein the condensate distribution system comprises one or more perforated dissipation pans positioned above the one or more walls and configured to receive the liquid condensate from a drain line of the refrigeration system.

15. The temperature-controlled display device of claim 13, wherein the condensate distribution system comprises a perforated hose positioned above the one or more walls and configured to receive the liquid condensate from a drain line of the refrigeration system.

16. The temperature-controlled display device of claim 12, wherein the one or more walls are positioned in the airflow downstream of a heat-rejecting element of the refrigeration system;

wherein the airflow absorbs heat from the heat-rejecting element and the heated airflow passes through the one or more walls.

17. The temperature-controlled display device of claim 12, wherein evaporating the liquid condensate cools the airflow and the cooled airflow is provided to a condenser of the refrigeration system to absorb heat from the condenser.

18. The temperature-controlled display device of claim 12, wherein the evaporative condensate dissipation system further comprises a receptacle positioned below the one or more walls and configured to capture at least a portion of the liquid condensate not retained within the porous material of the one or more walls.

19. The temperature-controlled display device of claim 18, wherein the one or more walls are at least partially submerged in the liquid condensate in the receptacle;

wherein the one or more walls are configured to wick the liquid condensate from within the receptacle and to retain the wicked liquid condensate within the porous material.

20. The temperature-controlled display device of claim 18, wherein:

the liquid condensate from the refrigeration system is introduced to an upper portion of the one or more walls and flows downward through the one or more walls toward the receptacle;

the one or more walls absorb the liquid condensate introduced to the upper portion until the one or more walls become fully saturated with the liquid condensate; and the receptacle captures the liquid condensate introduced to the upper portion after the one or more walls become fully saturated with the liquid condensate.

21. The temperature-controlled display device of claim 18, wherein the evaporative condensate dissipation system further comprises:

a drain line configured to receive the liquid condensate from the receptacle; and a pump disposed along the drain line and configured to pump the liquid condensate from the receptacle toward an upper portion of the one or more walls, wherein the pumped liquid condensate is reintroduced to the one or more walls at the upper portion.

22. The temperature-controlled display device of claim 18, wherein:

the liquid condensate from the refrigeration system is received in the receptacle, introduced to a lower portion of the one or more walls submerged in the liquid condensate, and flows upward from the lower portion through the one or more walls;

the one or more walls absorb the liquid condensate introduced to the lower portion until the one or more walls become fully saturated with the liquid condensate; and the receptacle retains the liquid condensate introduced to the lower portion after the one or more walls become fully saturated with the liquid condensate.

* * * * *